United States Patent [19]

Barouh et al.

[11] 4,007,823

[45] * Feb. 15, 1977

[54] TYPEWRITER CORRECTION MATERIALS EMPLOYING ADHESIVES

[76] Inventors: Victor Barouh, 935 Plum Tree Road West, Westbury, N.Y. 11590; Robert Glenn, 70-20 108th St., Forest Hills, N.Y. 11375

[ * ] Notice: The portion of the term of this patent subsequent to Aug. 14, 1990, has been disclaimed.

[22] Filed: July 5, 1973

[21] Appl. No.: 376,886

[52] U.S. Cl. ..... 197/181; 197/172

[51] Int. Cl.[2] ..... B41J 29/16

[58] Field of Search ..... 197/151, 156, 172, 181, 197/184, 185

[56] References Cited

UNITED STATES PATENTS

| | | | |
|---|---|---|---|
| 1,183,424 | 5/1916 | Baldwin | 197/181 |
| 1,222,592 | 4/1917 | Baldwin | 197/181 UX |
| 1,399,734 | 12/1921 | Baldwin | 197/181 X |
| 1,415,293 | 5/1922 | Baldwin | 197/181 |
| 1,905,118 | 4/1933 | Nadell | 197/181 |
| 2,258,547 | 10/1941 | Dodds | 197/184 UX |
| 2,392,517 | 1/1946 | Banister | 197/181 X |
| 2,736,911 | 3/1956 | Larsen | 197/184 UX |
| 2,767,650 | 10/1956 | Yunker et al. | 197/181 |
| 2,790,742 | 4/1957 | Wharton | 197/172 UX |
| 2,836,152 | 5/1958 | Rosenblum | 197/181 X |
| 2,851,008 | 9/1958 | Rochester | 197/181 UX |
| 2,964,771 | 12/1960 | Hornor | 197/184 UX |
| 3,154,183 | 10/1964 | Wolowitz | 197/181 X |
| 3,155,216 | 11/1964 | Talmage | 197/181 |
| 3,410,251 | 11/1968 | Glenn et al. | 197/181 X |
| 3,505,699 | 4/1970 | Trumbull | 197/184 X |
| 3,552,990 | 1/1971 | Barough | 197/181 UX |
| 3,704,150 | 11/1972 | Barouh et al. | 197/181 UX |
| 3,724,633 | 4/1973 | Korb et al. | 197/181 X |
| 3,752,291 | 8/1973 | Barouh et al. | 197/181 X |
| 3,788,442 | 1/1974 | Lehnhardt et al. | 197/151 X |

FOREIGN PATENTS OR APPLICATIONS

| | | | |
|---|---|---|---|
| 192,548 | 2/1923 | United Kingdom | 197/181 |

*Primary Examiner*—E. H. Eickholt
*Attorney, Agent, or Firm*—Kenneth S. Goldfarb

[57] ABSTRACT

Typewriter correction materials employing adhesives including a base strip of light-transmitting material. A transfer strip having a coating of ink thereon is bonded to the base strip and a character-removing strip having a coating of an adhesive thereon is also bonded to the base strip in spaced parallel relation to the transfer strip. Another embodiment of the invention conceives of utlizing an adhesive on a tab while including in the concept the use of separate transfer ribbons arranged in a typewriter. Yet another embodiment conceives of employing an adhesive on the end of an applicator which is pressed against the typed error for removing the typed error from the material and being then pressed against an adhesive material having greater adhesive attraction than the used adhesive on the applicator.

3 Claims, 8 Drawing Figures

SEPARATE INKED & ADHESIVE RIBBONS ARRANGED IN TYPEWRITER

ADHESIVE ON END OF PENCIL OR THE LIKE — PRESSURE AGAINST TYPED ERROR WILL REMOVE THE ERRONEOUSLY TYPED MATERIAL

TYPEWRITER CORRECTION MATERIALS EMPLOYING ADHESIVES

BACKGROUND OF THE INVENTION

1. Field of the Invention

This invention relates to typewriter correction materials employing adhesives and is especially adapted for use in conjunction with typewriter ribbons of the type that are coated with a non-absorbent carbon material which does not wet the paper onto which it is typewritten.

2. Description of the Prior Art

Various types of typewriter ribbons have been devised in the past which are manufactured out of various non-absorbent ink compositions of transfer materials which do not wet or dye the paper onto which the characters are printed. These transfer materials are generally of a relatively dry wax composition and may have one or more coatings for preventing penetration of the transfer material into the paper.

Various types of correction ribbons for typewriters have been devised which include a transfer portion and an ink correction material such as is shown in U.S. Pat. No. 3,141,539. However, in correcting errors made by a typewriter using non-absorbent non-penetrating non-wetting ink, it has been found that complete removal of such ink material is preferable to coating thereof with a correction material and then striking a correct character thereover.

SUMMARY OF THE INVENTION

It is the object of the present invention to provide adhesive means for removing incorrect typed characters of non-penetrating, non-absorbent, non-wetting transfer material. In carrying out the invention, a strip coated with an adhesive portion is provided which is adapted to be pressed between typewriter keys directly over the erroneous character. This strip may be separate and in the form of a tab or sheet, or may be, in another embodiment, a separate adhesive ribbon arranged on a typewriter. Alternatively, a composite ribbon may be provided having a base, preferably of a transparent material with a transfer strip and an adhesive strip bonded thereto.

An alternative arrangement is to use a pencil-like wand or rod carrying adhesive on the end thereof which is pressed against the incorrect character to remove the character and then pressed against another adhesive material of a greater adhesive quality to retack the adhesive end of the wand.

These, together with the various ancillary objects and features of the invention which will become apparent as the following description proceeds, are attained by these correction materials employing adhesives, preferred embodiments of which are illustrated in the accompanying drawing by way of example only, wherein:

DETAILED DESCRIPTION OF THE INVENTION

Figure 1:
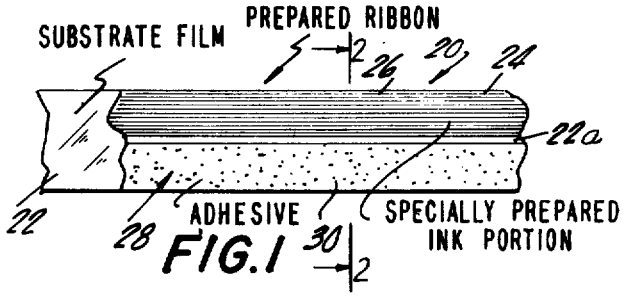
FIG. 1 is a plan view showing an embodiment of the composite typewriter correction ribbon according to the present invention.
Figure 2:
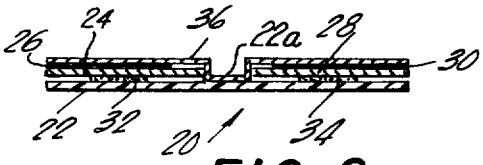
FIG. 2 is a transverse sectional view taken along the plane of line 2 — 2 in FIG. 1.

With continuing reference to the accompanying drawing wherein like reference numerals designate similar parts, and with attention initially directed to the embodiment of FIGS. 1 and 2 wherein there is shown a typewriter correction ribbon 20 including a base strip 22 of natural or synthetic plastic, thin woven or film material, such as nylon, silk or cotton and which is preferably non-absorbent and effectively light-transmitting. The base strip 22 is preferably of the order of 0.001 inch in thickness and is preferably of woven nylon because of the sponginess of nylon which acts as a cushion to striking typewriter type faces. This cushion effect results in an even transfer of the inked transfer material. A transfer strip 24 is formed of any suitable thin film plastic material such as nylon, polyethylene, acetate, rayon, Mylar and the like, and has a coating 26 thereon of a non-absorbent, non-penetrating, non-wetting ink transfer material. A contact strip 28 is provided which has a coating 30 of an adhesive. The strip 28 is formed of paper or nylon, polyethylene, Mylar, acetate or the like which is adhesive and fluid and pervious. The transfer strip 24 and the correction strip 28 are secured to the base strip 22 by very thin coatings 32 and 34 of a suitable adhesive to expose light transmitting base 22 therebetween as illustrated at **22*a* in FIGS. 1 and 2. The coatings 32 and 34 are much narrower than the strips 24 and 28 respectively, and are centered with respect thereto. When typewriter type faces strike the back of base 22 the very thin adhesive coatings 32 and 34 will provide an additional cushion so that unexpectedly sharp impressions are achieved. Because the strips 24 and 28 are of exactly the same thickness ranging between 0.002 and 0.003 inch in thickness, very accurate corrections will be achieved and the entire ribbon 20 may be wound in a flat and even manner. It is within the concept of the present invention to provide a coating 36 of a waxy material which will facilitate such winding and unwinding. The coating 36 is transparent and is of such nature and so thin that the coating 36 will not transfer with the adhesive of the transfer material to the paper on which it is being typed and will mix with the adhesive when the strip 28** is struck so as to allow the adhesive to pull an erroneous typewritten character off the paper on which it had been previously typed.

Figure 3:
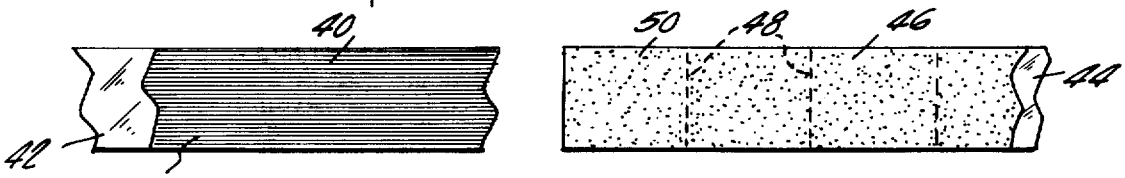
FIG. 3 is a plan view of a modified form of the invention.
Figure 4:
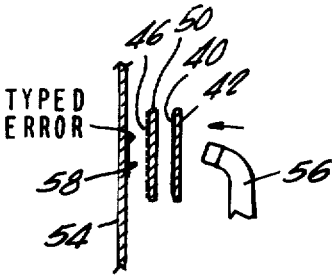
FIG. 4 is a schematic view showing the manner in which the embodiment of FIG. 3 is employed.
Figure 5:
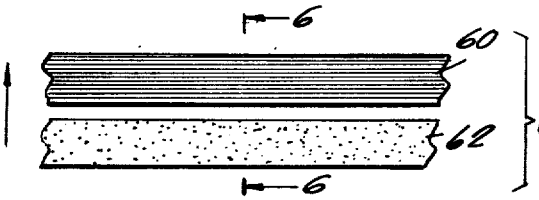
FIG. 5 is a plan view of a further embodiment of the invention.

Referring now to FIGS. 3 and 4, there is shown a composite arrangement including a non-absorbent transfer ink 40 which is coated on a substrate 42 and used as a conventional typewriter ribbon. A second substrate 44 in the form of a film or paper is coated with an adhesive 46 and then cut in any suitable manner by perforations 48 into tabs 50. These tabs 50 are of any desired convenient shape.

In order to correct an error using the tabs 50, after the error has been typed, the typewriter is back-spaced, the tab 50 is inserted between the paper 54 and the substrate 42 with the adhesive side 46 of the tab 50 toward the paper 54. The typewriter key of the character in error is then struck, thereby actuating striker 56 and removing the erroneous impression 58. Then, the tab 50 is removed, the typewriter is back-spaced and the correct and desired impression is made. This arrangement can best be seen in FIG. 4.

Figure 6:
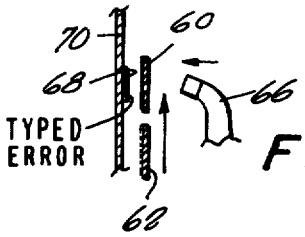
FIG. 6 is a schematic sectional view taken along the plane of line 6 — 6 in FIG. 5 illustrating the manner in which the embodiment of FIG. 5 is employed.

The concept of this invention also includes the use of two separate ribbons. One ribbon consists of an inked or writing ribbon 60 while the other ribbon is an adhesive or correction ribbon 62. In this case both ribbons 60 and 62 are simultaneously mounted in a typewriter. The mechanism of the typewriter is so arranged that the inked or writing ribbon 60 can be shifted out of the way and the correction ribbon 62 can be shifted to the desired position for making the correction. In this form of the invention, the typewriter striker shown in FIG. 6 and indicated as 66, when struck, will cause a character 68 to be positioned on the paper 70. If it is desired to remove the character 68, the typewriter is back-spaced and the adhesive ribbon 62 is moved up into position in alignment with the typewriter striker 66 so as to remove from the paper the character 68.

Figure 7:
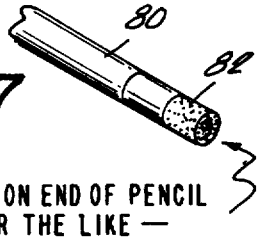
FIG. 7 is a perspective view of another embodiment of the invention.
Figure 8:
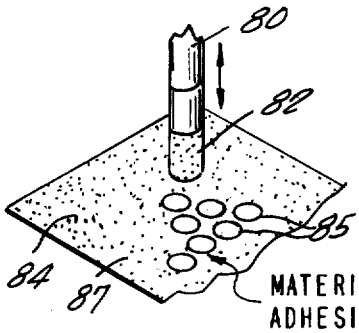
FIG. 8 is a perspective view showing one step in the use of the embodiment shown in FIG. 7.

As shown in FIGS. 7 and 8, the adhesive material can be constructed in the form of a truncated conical tip positioned on a pencil-like wand or stick 80, or actually in the form of a pencil eraser 82 actually placed on a pencil. When an error is made, the eraser 82 of adhesive which is in a tapered truncated conical shape, is brought into contact with the typewriter character and a slight pressure is applied. This pressure will remove the typewritten impression from the paper leaving the paper clean and ready to receive a new impression. The adhesive tip is then cleaned by bringing it into contact and applying a slight pressure on a sheet 87 coated with a pressure-sensitive adhesive 84 possessing a higher degree of tack than that of the adhesive on the eraser 82. The typewritten impressions collected on eraser 82 thus adhere to sheet 87 as represented at 85.

A latitude of modification, substitution and change is intended in the foregoing disclosure, and in some instances, some features of the present invention may be employed without a corresponding use of other features.

We claim:

1. Typewriter correction material comprising a base strip of thin light transmitting non-inked material, spaced parallel coatings of adhesive on said base strip, a correction strip comprising an elongated strip of material coated with an adhesive material, a transfer strip of fluid impervious thin plastic material coated with a transfer material, said correction strip and said transfer strip being bonded to said base strip by said parallel coatings, a light transmitting wax like coating overlying said adhesive material and said transfer material, and wherein said transfer strip and said correction strip are arranged in spaced parallel relationship with said transfer strip and said correction strip each being arranged along a respective edge of said base strip with a central light transmitting window therebetween for facilitating proper alignment for correction of typewritten impressions.

2. Typewriter correction material according to claim 1, wherein said transfer strip and correction strip are of the same thickness so that said correction material can be wound and rewound flatly and evenly, said transfer strip and said correction strip being substantially wider than said adhesive coatings with said adhesive coatings medially disposed between the edges of said correction strip and said transfer strip forming cushions for the central portions of said correction strip and said transfer strip so that the impressions therefrom are enhanced.

3. A typewriter correction material according to claim 2, wherein said base strip is formed of fibers of a material selected from the group consisting of nylon, silk and cotton.

* * * * *